US005729961A

United States Patent [19]

Dauder-Guardiola

[11] Patent Number: 5,729,961

[45] Date of Patent: Mar. 24, 1998

[54] PROCESS FOR OBTAINING PACKETS FULL OF PRODUCTS BY MEANS OF A CONTINUOUS TUBE OF NET

[75] Inventor: Agustin Dauder-Guardiola, Badalona, Spain

[73] Assignee: Talleres Daumar S.A., Badalona, Spain

[21] Appl. No.: 643,367

[22] Filed: May 6, 1996

[30] Foreign Application Priority Data

May 16, 1995 [ES] Spain ..... 9500931

[51] Int. Cl.[6] ..... B65B 9/13

[52] U.S. Cl. ..... 53/459; 53/451; 53/567

[58] Field of Search ..... 53/451, 459, 567, 53/469, 563

[56] References Cited

U.S. PATENT DOCUMENTS

| | | | |
|---|---|---|---|
| 3,662,514 | 5/1972 | Goss | 53/567 |
| 3,908,335 | 9/1975 | Giannelli | 53/567 |
| 3,939,628 | 2/1976 | Schjeldahl | 53/567 |
| 4,016,704 | 4/1977 | Fujio | 53/459 |
| 4,765,121 | 8/1988 | Konstantin et al. | 53/567 |
| 5,570,565 | 11/1996 | Simpson | 53/459 |

FOREIGN PATENT DOCUMENTS

| | | |
|---|---|---|
| 0 742 149 A2 | 4/1995 | European Pat. Off. . |
| 475371 | 11/1978 | Spain . |
| P 9500765 | 4/1995 | Spain . |

*Primary Examiner*—Daniel Moon
*Assistant Examiner*—John Paradiso
*Attorney, Agent, or Firm*—Darby & Darby

[57] ABSTRACT

A process for obtaining packets full of products by means of a continuous tube of net, which comprises placing the net about a tubular means, pulling the top end of the net upwards and carrying it up to a certain height above the tubular means, expanding the portion of conveyed net sideways, pinching and closing the lower end of the net portion and shearing such portion, detaching it from the rest of the tubular net, filling the formed container and closing its top mouth.

1 Claim, 1 Drawing Sheet

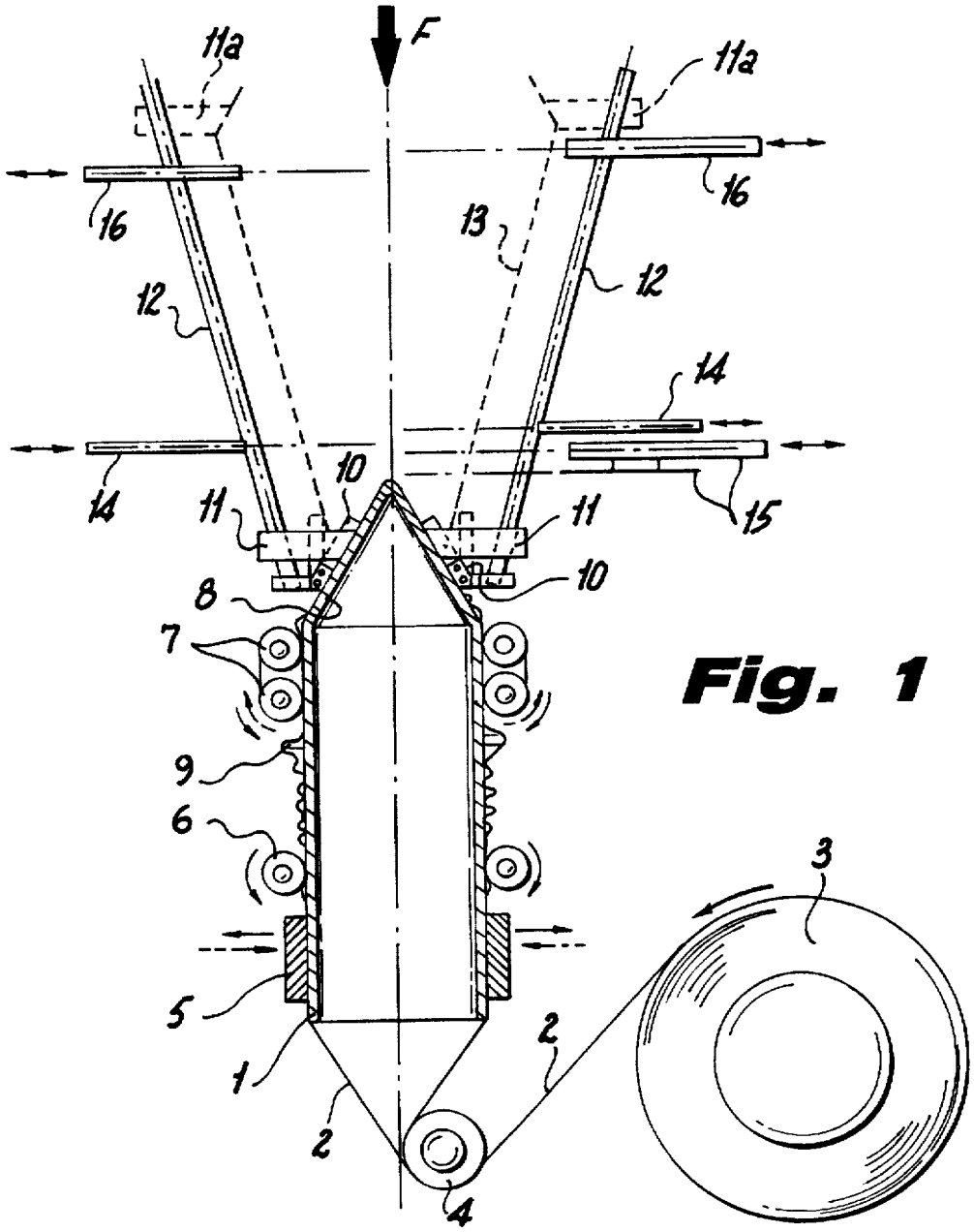
Fig. 1
Fig. 2
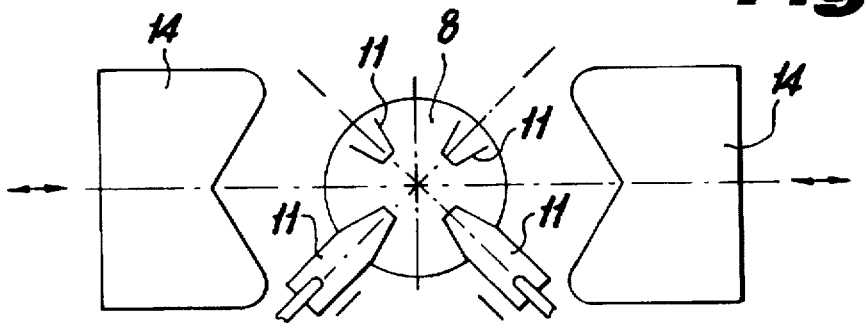

PROCESS FOR OBTAINING PACKETS FULL OF PRODUCTS BY MEANS OF A CONTINUOUS TUBE OF NET

FIELD OF THE INVENTION

The object of the present Patent is a process for obtaining packets full of products by means of a continuous tube of net, the products being in particular fruits, vegetables and the like, as well as foodstuffs of all sorts and kinds and generally any products or items whatsoever that are to be packaged in packets, their total weight or quantity being usually predetermined.

The continuous tube of net is generally made of a plastic material, although a vegetable, paper or like material could be used.

BACKGROUND OF THE INVENTION

A known automatic machine exists for the continuous formation and closure of net bags obtained from a tubular net which is the object of Spanish Patent number 475,372 granted on 20-2-79 to Mr Agustin Dauder Guardiola and is essentially characterised by comprising an assembly of two vertically arranged telescopic tubes, namely a fixed inner tube and a sliding outer tube, a third removable tube carrying a certain quantity of the tubular net arranged about the same being disposed over the assembly aforesaid. And the three tubes altogether communicate at the top with a hopper supplying the product to be packaged, which is supplied duly measured, particularly as to its weight.

The sliding tube is activated axially downwards by a cylinder of adjustable stroke, pulling the required net portion to form a bag of suitable capacity to accommodate the quantity of product supplied, immediately retrieving its initial position.

Certain means are provided, articulated to each other and driven overall by a pneumatic cylinder, which means pinch and gather the net portion supplied, and comprise two sets of two blades each, acting on either side of the net, travelling along a horizontal plane, across the axis of said net and flush with the lower end of the sliding tube in its initial position.

Said sets of blades lie overlapping in their active position, the top set making up a support for the bottom of the bag receiving the product discharged by the hopper into the tube. The blades of the top set are provided with a throat that works with the angular edge of blades of the opposite set to establish the pinching of the net aforesaid, a clamping and shearing head being provided at the back of said throat attached to the top set of blades and lying on the virtual axis of the telescopic assembly.

The head closes the mouth of the bag that is to be formed and establishes a closure for the bottom of the next bag, whereupon the blades are moved back to the set limit and a new cycle begins.

The telescopic tube assembly is mounted on a common support in order to allow the removable tube bearing the net to be removed, although said assembly may in practice be mounted on a common turning support, with another removable tube to be filled with tubular net and placed in lieu of the tube that has just been emptied. Each tube is fitted at its lower end with two rings and an annular spring is arranged between them to serve as braking means and avoid an untimely downward sliding of the net.

The process carried out by the foregoing machine basically comprises placing a certain quantity of tubular net about the outer removable tube, manually lowering the net until it projects beyond said removable tube below the clamping head, pinching the lower free end of the net and placing a clamp to close its lower mouth, overlapping the two sets of blades to provide a support for the bottom of the bag thus formed, unloading the product into the bag from the hopper located above the top end of the telescopic assembly of said three tubes, moving the sets of blades back until the full bag lies below the same, activating the clamping and shearing head that closes the mouth of the full bag and establishes a closure for the bottom of the next bag, likewise defining the support therefor, and then separating the full bag from the rest of the tubular net and beginning a new cycle as described above.

A disadvantage of the process carried out by said machine lies in that the product must drop from a certain height, delimited by the telescopic assembly of three tubes of the machine, down to the bottom of the bag, the lower end of which is closed, and the first items of the product bang against the rigid support at the bottom of the bag receiving the product discharged by the hopper. And such height of the telescopic assembly is quite large in order to be able to store a rather large quantity of tubular net and thereby cut down on the idle time taken to change tubes or fill the same with another batch of tubular net. This is prejudicial for delicate products, namely certain fruits for instance, and the height over which these delicate products must drop must be as small as possible, hence limiting the length of the tube holding the net and of the net as such.

SUMMARY OF THE INVENTION

In order to remedy the disadvantages stemming from the known process and concurrently provide advantages that will be explained hereinafter, the present invention proposes a process for obtaining packets full of products by means of a continuous tube of net, of the kind which comprises forming a bag with its lower end closed and its top end open, filling the bag with the desired products, closing the top end of the bag, shearing it and detaching it from the rest of the tube of net.

This process is characterised by the following operative stages:

a) Carrying the tubular net from its storage means and arranging it about a tubular means, placing a certain length of net between two pulling means, namely top and lower means, spaced from each other and located on the tubular means; and applying gripping means to the latter, the gripping means lying beneath the lower pulling means, placing the relevant lower part of the conveyed tubular net in between;

b) raising the top part of the tubular net with the top pulling means, placing it on a convex or conical top end of the tubular means; and applying net retaining means to said top part of the raised net;

c) pinning the top end of the tubular net with holding means, deactivating the retaining means, raising the net up to a certain height and moving the holding means sideways and outwardly to form a portion of expanded tubular net;

d) closing pinching and supporting means located above the top end of the tubular means, pinching a lower part of the portion of expanded net formed; activating the retaining means, sealing and shearing the tubular net lying beneath the pinching and supporting means, and filling the container thus made and supported on the latter means with the desired products;

e) sealing the top end of the container and removing the full packet obtained, opening the pinching and supporting means and inverting the previous movements of the holding means until the top end of the tubular net held by the activated retaining means is pinned; and f) repeating operative stages c), d) and e) to obtain new packets full of products.

The process for obtaining packets full of products by means of a continuous tube of net overcomes the disadvantage of the machine subject of Spanish Patent number 475,372 and provides the following advantages, inter alia, over the same: a gentler treatment of the products to be contained because the distance over which they drop into the container to be filled is smaller; and a better performance as to the number of full packets to be obtained, since a continuous tube of net is used and hence the stops to replace the reel or container of the continuous tube of net are relatively few in number, as compared with a far greater number of stops in the known processes, which use batches of tubular net whose length is limited by the actual length of the removable tube of known machines, which removable tube has a length limited by the height over which the product to be packaged must drop.

The very applicant has also applied for Spanish Patent number 9500765, filed on 20-4-95, the object of which is a process for obtaining bags full of products from batches of tubular net, of the kind which consists in arranging a certain quantity or batch of tubular net about an upstanding tube, forming a bag with its lower end closed and its top end open, filling the bag with the desired products from product unloading means, closing the top end of the bag, shearing it, and detaching it from the rest of the batch of tubular net. And said process is characterised by the following operative stages:

a) First inserting the top end of the tubular net inside the tube through its top mouth, lowering the tubular net until its free end projects under the tube and applying closure means to such free end;

b) lifting the tubular net so that its free lower closed end reaches a certain height within the tube, forming a bag with its top end open and unloading the product into it;

c) lowering the tubular net inside the tube until the full bag projects under the tube, applying closure means to its top end and other separate means situated slightly above the first means and shearing the pinched net midway between the two closure means, separating the full bag obtained from the rest of the tubular net; and d) repeating operative stages b) and c) to obtain new bags full of products until the batch of tubular net stocked in the tube is depleted, whereupon the process starts again at operative stage a) in a tube loaded with another batch of tubular net about the same.

The process subject of Spanish Patent number 9500765 overcomes the disadvantage aforesaid of the process carried out by the machine subject of Spanish Patent number 475,372 and contributes the following advantages, among others: a gentler treatment of the products to be contained within the relevant bags; the tube can have any desired length and may therefore initially contain a rather large quantity of tubular net; and a better performance since the idle time required to replace the empty tube with a full tube is reduced in the desired proportion.

Furthermore, the said process subject of the present invention contributes the following advantages, inter alia, over the process subject of Patent number 9500765applied for by the very applicant for the present invention: a better performance as to the number of full packets to be obtained, since a continuous tube of net is used and hence the stops to replace the reel or container of the continuous tube of net are relatively few, as compared with a greater number of stops in the process subject of Patent number 9500765, which uses batches of tubular net whose length is limited by the actual length of the removable tube, which must be replaced once the batch of tubular net arranged about the same is depleted.

The carrying out of the process subject of the present invention provides the foregoing advantages in addition to others that will follow easily from the embodiment of said process that is described hereinafter for an easy understanding of the features set out above, contemporaneously giving certain functional details, a number of drawings being attached to such end which show a practical embodiment of said process that is meant to illustrate rather than limit its scope.

BRIEF DESCRIPTION OF THE DRAWINGS

The drawings show a diagram of a plant for obtaining packets full of products by means of a continuous tube of net which when in operation carries out the process in accordance with the invention and an embodiment thereof.

FIG. 1 is a front elevation view of the diagram of the plant and

FIG. 2 is a plan view which shows neither the tubular net nor other means shown in FIG. 1 in the interests of clarity, and as described hereinafter.

DESCRIPTION OF AN EMBODIMENT OF THE INVENTION

In order to better understand the process carried out by said plant, a description will first of all be made of the plant as it relates to said process. The plant comprises a vertical tube or tubular means (1) -a cross-section of which is shown in FIG. 1- which tube could be inclined to expedite discharge of the product to be packaged, as appropriate. The tubular net (2), taken from a reel (3) or roll or indeed taken from a tubular net container, will be arranged about the tube (1), the plant having a pulley or guide means (4) to suitably shunt and align the tubular net towards such tube (1).

From bottom to top, the tube (1) has: gripping means (5) that are applied to the lower part of the tube with the relevant part of the tubular net (2) in between; lower pulling means (6) applied against the tube (1); and top pulling means (7) also applied against the tube (1).

The top of the tube (1) extends into a conical end (8), which end may be convex in shape, for instance as a spherical cap, and may also have holes or salients in order for gathering of the top end of the tubular net from this part to be easier, as explained hereinafter. A ring (9) or another device may be arranged about the tube (1) acting as an element braking the tubular net arranged about said tube.

The conical end (8) supports temporary retaining means (10) such as levers, small wheels or the like, and which in the subject example consist of levers with lower articulated ends, which may turn and be applied against the conical end (8), with the top end of the tubular net (1) in between, or may be moved away from said conical end, thereby releasing the tubular net as explained hereinafter. These retaining means (10) or articulated levers in this example do not allow the tubular net to move back due to the stress resulting from the actual nature of the net material -natural or synthetic fibres- and the way in which it is made -in textile mills or by extrusion-.

The plant comprises means (11) holding the tubular net (1), in the form of pincers in this example, four of which are shown in FIG. 2 (two of the pincers are shown schematically and the other two in part) the pincers being supported by and guided in guide means (12) which, for instance, comprise fixed bars arranged to be upwardly inclined or divergent as shown in FIG. 1, and not shown in FIG. 2.

The holding means (11) pin the top end of the tubular net (1) lying on the conical end (8) and are upwardly driven, after the retaining means (10) are deactivated, carrying the tubular net up to a certain height, said holding means (11) contemporaneously moving sideways and outwardly as shown in FIG. 1 at the position of the pincers (11*a*) to form an expanded portion (13) of said tubular net. It is noteworthy that depending on the number of pincers or holding means (11), the shape of the top mouth of said expanded portion (frustum-of-the-pyramid) will be polygonal, which may be more or less regular and indeed tend towards a more or less circular shape. The height and diameter to which the tubular net is pulled or carried as above-mentioned will be adjusted depending on the size of the final packet to be obtained.

FIG. 2 shows the pincers or holding means (11) at their lowermost position, i.e. applied against the conical end (8).

Pinching and supporting means (14) lie beyond and above the conical end (8), which FIGS. 1 and 2 show in an idle position, i.e. with said means open or separated, which on closing or coming together pinch the lower part of the expanded portion (13) of the tubular net, which they moreover support when it is subsequently filled with the desired products. Sealing and shearing means (15) - not shown in FIG. 2 - are provided beneath such pinching and supporting means (14) which, when activated, cause the lower part of said expanded portion (13) to be closed and sheared, defining a container with its lower end closed and its top end open, and being separated -due to said lower shearing- from the rest of the tubular net (2) which shall be temporarily held by the retaining means (10), previously activated before such sealing and shearing, thereby for the mouth of the next expanded portion of tubular net and subsequent container to fill to be formed.

The said container, now constituted, may be filled with the desired products, which are inserted through the top open mouth of said container as shown by arrow (F), which indicates the direction in which the products are discharged into said container. The products to be packaged may be inserted once the pinching and supporting means (14) are closed, and whilst sealing and shearing as aforesaid.

Once the products have been loaded into the subject container, supported on said pinching and supporting means (14), the sealing means (16) (only shown in FIG. 1) are activated to close the top end of the container thereby to obtain a full packet. Said sealing means are deactivated, i.e. drawn away from the vertical axis of the tube (1) and the full packet obtained is removed, the pinching and supporting means (14) opening or separating, and the movements made by the holding means (11) being inverted, moving down from position (11*a*) to position (11) in order to pin the next top end of the tubular net (2) held by the activated retaining means (10), thereby to form a new expanded portion as described above, continuing as described in order to obtain a new full packet, and so on.

The process carried out by the plant described is as follows:

The tubular net (2) taken from the reel or roll (3) (or taken, as appropriate, from a tubular net container) is arranged about the tube or tubular means (1), with the gripping means (5) deactivated or drawn away from such tube, and a certain length of net is placed between the lower (6) and top (7) pulling means, causing the lower pulling means (6) to turn in the direction indicated by the arrows of FIG. 1. Having carried such quantity of net, the gripping means (5) are applied to the tube (1) and the tubular net. The top end of the tubular net is then carried by action of the top pulling means (7) in the direction indicated by the arrows of FIG. 1 until said top end of the net reaches the conical end (8), and the retaining means (10) are applied to such top part of the conveyed net; FIG. 1 shows other arrows, in phantom and pointing counter to the previous arrows, indicating an opposite movement of the pulling means (7) to fit the top end of the net tightly to the conical end (8).

The holding means (11) pin the top end of the tubular net, as the retaining means (10) are deactivated, and the tubular net (2) is raised up to a certain height by the holding means (11) which travel along the guide means (12), the holding means contemporaneously moving sideways and outwardly, thereby to form an expanded portion (13) of tubular net.

The pinching and supporting means (14) are closed, pinching the lower part of the expanded portion (13) of net formed, the retaining means (10) are activated to temporarily hold the tubular net against the conical end (8) and the sealing and shearing means (15) are activated to close and shear the lower part of said expanded portion (13) of tubular net lying beneath the pinching and supporting means (14), thereby defining a container with its lower end closed and its mouth open and held temporarily by the holding means (11*a*), separating said container from the rest of the tubular net, the top end of which is supported and held temporarily by the retaining means (10) against the conical end (8) of the tube (1).

Said container is filled, supported on the pinching and supporting means (14), with the desired products that are discharged from above the mouth of said container in the direction indicated by arrow (F). The products to be packaged can be inserted in the container after closing the pinching and supporting means (14) and while said sealing and shearing means (15) perform said sealing and shearing function.

When loading of the container is over, the sealing means (16) seal its mouth or top end and the full packet thus obtained is removed, opening or moving back the pinching and supporting means (14) and inverting the movements previously carried out by the holding means (11) which are lowered from this uppermost position (11*a*) to their lowermost position (11), pinning the next top end of the tubular net (12) held temporarily by retaining means (10) at such lowermost position, the operative stages aforesaid being repeated from this position of the holding means (11) pinning the top end of the tubular net to raise it up to a certain height.

When the quantity or length of tubular net (2) placed between the lower (6) and top (7) pulling means is depleted or about to be so depleted, the gripping means (5) are deactivated and another certain length or quantity of said tubular net is carried by means of the lower pulling means (6) and arranged between such two pulling means, and thus the process for obtaining packets full of products from the continuous tube of net taken from the reel or roll (3) or a tubular net container (2) is not interrupted.

The various operative stages described above can be controlled and regulated by means of a program processing unit, thereby automating the whole process, which is consequently convenient as to its operation and performance per unit of time.

I claim:

1. A process for obtaining packets full of products by means of a continuous tube of net, the process comprises forming a bag with its lower end closed and its top end open, filling the bag with the products, closing the top end of the bag, shearing the top end of the bag and detaching the bag from the rest of the tube of net; the process comprising the steps of:

a) carrying the tubular net from its storage means and arranging it about a tubular means, placing a certain length of tubular net between a top pulling means and a bottom pulling means that are spaced from each other and located on the tubular means; and applying gripping means to the tubular means with intercalation of the tubular net, the gripping means placed beneath the bottom pulling means;

b) raising the top part of the tubular net with the top pulling means, placing the top part of the tubular net on a convex or conical top end of the tubular means; and applying net retaining means to said top part of the raised net;

c) pinning the top end of the tubular net with holding means, deactivating the retaining means, raising the net up to a certain height by the holding means that pinned the top end of the tubular net, and moving the holding means sideways and outwardly to form a portion of expanded tubular net;

d) closing pinching and supporting means located above the top end of the tubular means, pinching a lower part of the portion of expanded net formed; activating the retaining means, sealing and shearing the tubular net lying beneath the pinching and supporting means, and filling the container thus made and supported on the pinching and supporting means with the desired products;

e) sealing the top end of the container and removing the full container, opening the pinching and supporting means and lowering and moving the holding means sideways and inwardly until the top end of the tubular net held by the activated retaining means is pinned; and f) repeating operative stages c), d) and e) to obtain new containers full of products.

* * * * *

UNITED STATES PATENT AND TRADEMARK OFFICE

CERTIFICATE OF CORRECTION

PATENT : 5,729,961

DATED : March 24, 1998

INVENTOR(S) : Agustin Dauder-Guardiola

It is certified that error appears in the above-identified patent and that said Letters Patent is hereby corrected as shown below:

The title page, showing the illustrative Figure should be deleted and substitute therefor the attached title page.

In the drawings, delete Figures 1 and 2, and substitute therefor the corrected Figures 1 and 2, as shown on the attached pages.

Signed and Sealed this

Thirteenth Day of October 1998

*Attest:*

Bruce Lehman

BRUCE LEHMAN

*Attesting Officer*

*Commissioner of Patents and Trademarks*

United States Patent [19]

Dauder-Guardiola

[11] Patent Number: 5,729,961

[45] Date of Patent: Mar. 24, 1998

[54] PROCESS FOR OBTAINING PACKETS FULL OF PRODUCTS BY MEANS OF A CONTINUOUS TUBE OF NET

[75] Inventor: Agustin Dauder-Guardiola, Badalona, Spain

[73] Assignee: Talleres Daumar S.A., Badalona, Spain

[21] Appl. No.: 643,367

[22] Filed: May 6, 1996

[30] Foreign Application Priority Data

May 16, 1995 [ES] Spain ..... 9500931

[51] Int. Cl.[6] ..... B65B 9/13

[52] U.S. Cl. ..... 53/459; 53/451; 53/567

[58] Field of Search ..... 53/451, 459, 567, 53/469, 563

[56] References Cited

U.S. PATENT DOCUMENTS

| | | | |
|---|---|---|---|
| 3,662,514 | 5/1972 | Goss | 53/567 |
| 3,908,335 | 9/1975 | Giannelli | 53/567 |
| 3,939,628 | 2/1976 | Schjeldahl | 53/567 |
| 4,016,704 | 4/1977 | Fujio | 53/459 |
| 4,765,121 | 8/1988 | Konstantin et al. | 53/567 |
| 5,570,565 | 11/1996 | Simpson | 53/459 |

FOREIGN PATENT DOCUMENTS

| | | |
|---|---|---|
| 0 742 149 A2 | 4/1995 | European Pat. Off. . |
| 475371 | 11/1978 | Spain . |
| P 9500765 | 4/1995 | Spain . |

*Primary Examiner*—Daniel Moon
*Assistant Examiner*—John Paradiso
*Attorney, Agent, or Firm*—Darby & Darby

[57] ABSTRACT

A process for obtaining packets full of products by means of a continuous tube of net, which comprises placing the net about a tubular means, pulling the top end of the net upwards and carrying it up to a certain height above the tubular means, expanding the portion of conveyed net sideways, pinching and closing the lower end of the net portion and shearing such portion, detaching it from the rest of the tubular net, filling the formed container and closing its top mouth.

1 Claim, 1 Drawing Sheet

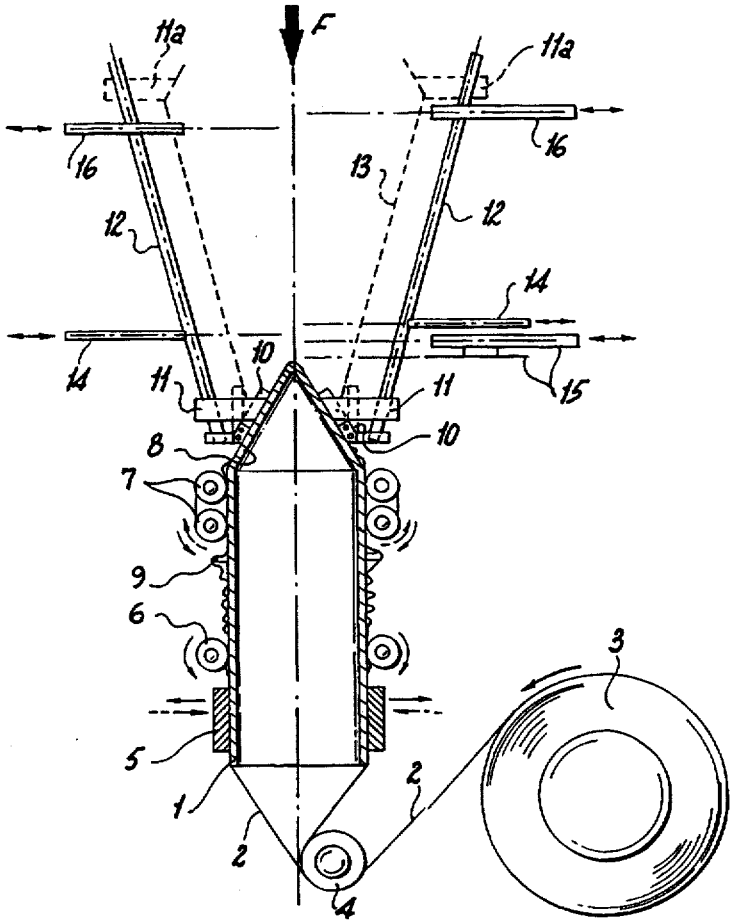

1/1
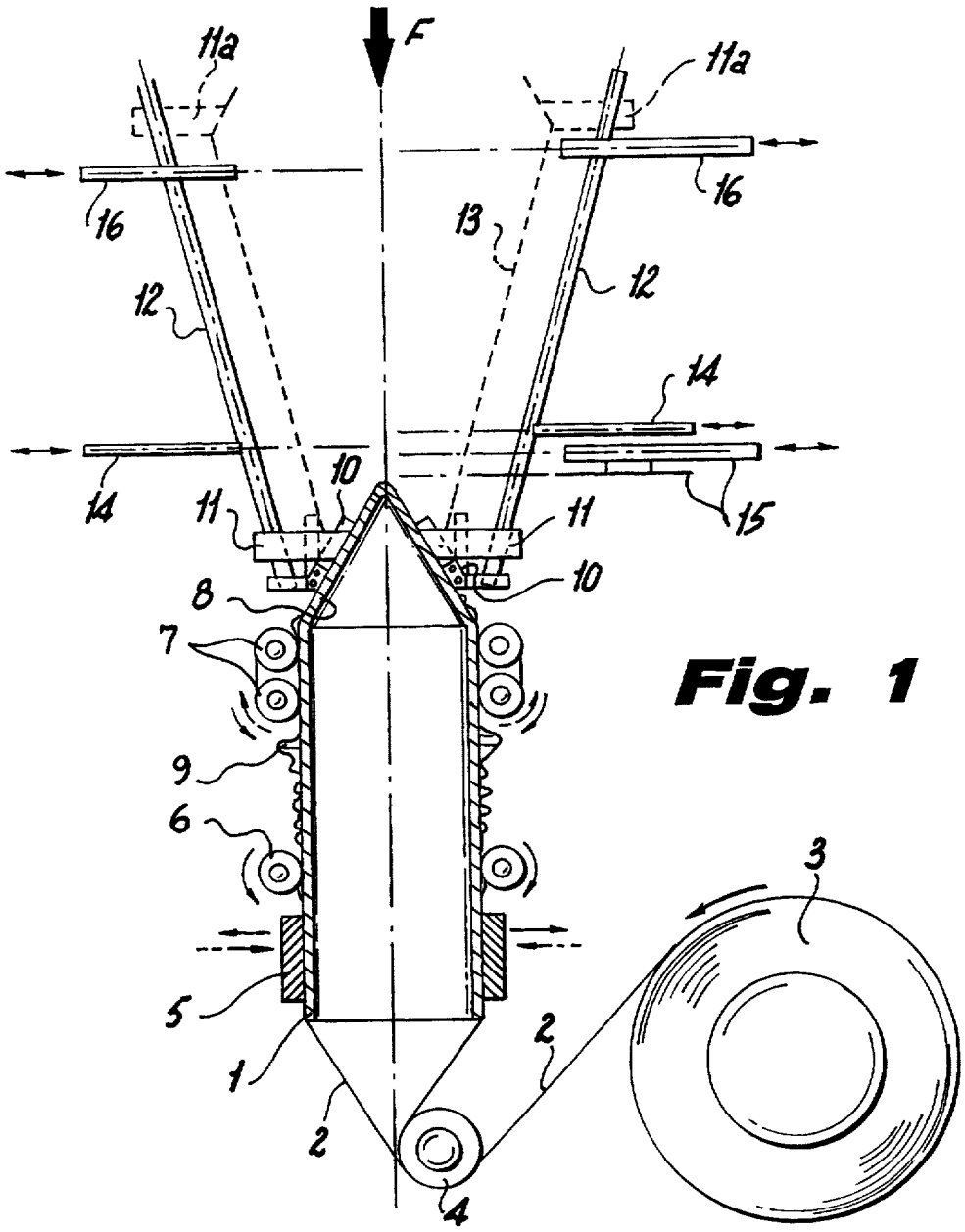
Fig. 1
Fig. 2
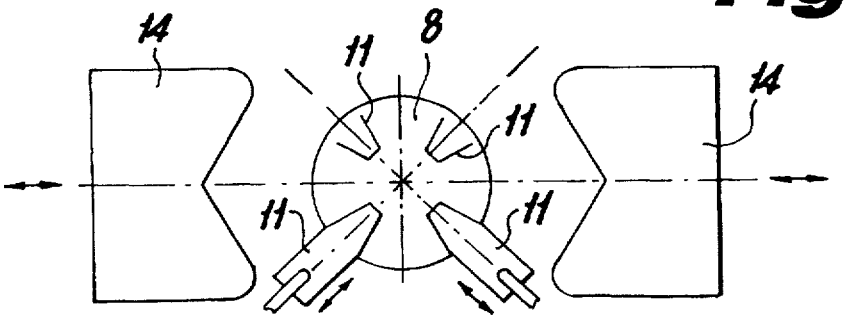

1/1